US011569052B2

(12) United States Patent
Bresciani et al.

(10) Patent No.: US 11,569,052 B2
(45) Date of Patent: Jan. 31, 2023

(54) POLE ACTUATION BOOSTER MECHANISM

(71) Applicant: ABB S.p.A., Milan (IT)

(72) Inventors: Nicola Bresciani, Bergamo (IT); Marco Bonfanti, Presezzo (IT)

(73) Assignee: ABB S.p.A., Milan (IT)

( * ) Notice: Subject to any disclaimer, the term of this patent is extended or adjusted under 35 U.S.C. 154(b) by 331 days.

(21) Appl. No.: 16/944,275

(22) Filed: Jul. 31, 2020

(65) Prior Publication Data

US 2021/0050169 A1 Feb. 18, 2021

(30) Foreign Application Priority Data

Aug. 2, 2019 (EP) ..... 19189912

(51) Int. Cl.
*H01H 71/10* (2006.01)
*H01H 1/20* (2006.01)

(52) U.S. Cl.
CPC ..... *H01H 71/1009* (2013.01); *H01H 1/205* (2013.01); *H01H 2071/1036* (2013.01)

(58) Field of Classification Search
CPC . H01H 71/1009; H01H 1/205; H01H 71/1036
(Continued)

(56) References Cited

U.S. PATENT DOCUMENTS 5,343,179 A * 8/1994 Pipich ..... H01H 71/2463 335/172
5,357,066 A 10/1994 Morel et al.
(Continued)

FOREIGN PATENT DOCUMENTS

FR 2891661 A1 4/2007
GB 2431046 A 4/2007
KR 1020100079913 A 7/2010

OTHER PUBLICATIONS

European Patent Office, Extended Search Report issued in corresponding Application No. 19189912.9, dated Jan. 8, 2020, 5 pp.

*Primary Examiner* — Alexander Talpalatski
(74) *Attorney, Agent, or Firm* — Armstrong Teasdale LLP

(57) ABSTRACT

A pole actuation booster mechanism for a four-poles low voltage circuit breaker, which includes: a first operating member adapted to be operatively connected to the operating shaft of the circuit breaker and moving together with said shaft during its rotation from an open position to a closed position, and vice-versa, of said circuit breaker over a range of movement having a first, a second and a third portion of movement, the first operating member having a first operating end; an operating assembly including at least an elastic element operatively connected to a lever, the first operating member being disengaged from said operating assembly during the first portion of its movement and engaged with the lever during the second and third portions of its movement. During a closing operation of the circuit breaker the first operating member moves first along the first portion of movement driven by the operating shaft and disengaged from the operating assembly, then moves along the second portion of movement driven by the operating shaft and engaged with the lever and transmitting energy to the operating assembly; and finally moves along the third portion of movement driven by the lever and transmitting energy to the operating shaft.

20 Claims, 8 Drawing Sheets

(58) Field of Classification Search
USPC ..... 335/8, 172
See application file for complete search history.

(56) References Cited

U.S. PATENT DOCUMENTS

| | | | | |
|---|---|---|---|---|
| 6,222,433 | B1 * | 4/2001 | Ramakrishnan | H01H 71/505 335/35 |
| 6,556,111 | B2 * | 4/2003 | Felden | H01H 71/446 335/38 |
| 7,538,644 | B2 | 5/2009 | Oh | |
| 9,799,477 | B2 * | 10/2017 | Fasano | H02H 3/093 |
| 2007/0075808 | A1 | 4/2007 | Ahn | |

* cited by examiner

POLE ACTUATION BOOSTER MECHANISM

The present invention relates to a pole actuation booster mechanism, in particular to a pole actuation booster mechanism adapted to operate on a pole of a four-poles low voltage circuit breaker.

It is known that in four-poles low voltage circuit breakers problems may arise as a consequence of the asymmetrical layout of the opening/closing driving mechanism with respect to the poles assembly. Indeed, while for a three-poles circuit breaker the opening/closing driving mechanism is generally associated with the central pole, and therefore with a symmetric distribution of forces on both lateral sides thereof, in a four-poles low voltage circuit breaker there is an unbalanced distribution of forces, generating flexion/torsion problems on the driving shafts and bringing about different performances among the poles during the closing/opening operations.

Different solutions have been proposed to solve or mitigate this problem.

For instance, U.S. Pat. No. 5,357,066 discloses an operating mechanism in which an auxiliary mechanism is positioned on the fourth-pole and is provided with a spring that exerts a given torque on the operating bar so as to compensate the flexion and/or torsion phenomena arising from the asymmetric position of the main operating mechanism.

In US2007/0075808 a "passive" unit aimed at preventing deformation of the driving shaft and/or correcting deformed regions thereof is interposed between the fourth pole (i.e. the one asymmetrically positioned with respect to the opening/closing driving mechanism) and the adjacent one.

However, none of the proposed solutions are completely satisfactory since they always involves relatively complicated mechanism with mechanical couplings that generate energy losses due to friction phenomena. Moreover, the relatively high number of components needed and/or their somehow complicated assembly and installation procedures in the circuit breaker involve relatively high costs, with a consequent increase of the manufacturing and assembly costs of the circuit breaker.

The main aim of the present invention is to provide a four-poles low voltage circuit breaker, in which the above-mentioned problems are solved or at least reduced.

It is therefore an object of the present invention to provide an auxiliary mechanism, in particular an auxiliary mechanism adapted to operate on a pole of a four-poles low voltage circuit breaker so as to avoid, or at least mitigate, the problems due to unbalanced distribution of forces along the main driving shaft and the components thereof.

It is a further object of the present invention to provide an auxiliary mechanism, in particular an auxiliary mechanism adapted to operate on a pole of a four-poles low voltage circuit breaker which is able to guarantee a uniform performance of the various poles during the closing/opening operations.

It is another object of the present invention to provide an auxiliary mechanism, in particular an auxiliary mechanism adapted to operate on a pole of a four-poles low voltage circuit breaker which is able to avoid, or at least mitigate, flexion/torsion problems on the driving shafts during the closing/opening operations thereof.

Still another object of the present invention is to provide an auxiliary mechanism, in particular an auxiliary mechanism adapted to operate on a pole of a four-poles low voltage circuit breaker, that can be easily manufactured at industrial level, at competitive costs with respect to the solutions of the state of the art.

In order to fulfill these objects, the present invention provides a pole actuation booster mechanism, in particular a pole actuation booster mechanism adapted to operate on a pole of a four-poles low voltage circuit breaker, said pole comprising an operating shaft, at least a fixed contact and at least a movable contact operatively coupled to said operating shaft and engageable to/disengageable from said fixed contact by rotation of said operating shaft during an opening/closing operation of said circuit breaker.

The booster mechanism of the present invention characterized in that it comprises:

a first operating member adapted to be operatively connected to said operating shaft and moving together with said shaft during its rotation from an open position to a closed position, and vice-versa, of said circuit breaker over a range of movement having a first, a second and a third portion of movement, said first operating member having a first operating end;

an operating assembly comprising at least an elastic element operatively connected to a lever, the first operating member being disengaged from said operating assembly during said first portion of its movement and engaged with said lever during said second and third portions of its movement; wherein during a closing operation of said circuit breaker said first operating member moves first along said first portion of movement driven by said operating shaft and disengaged form said operating assembly, then moves along said second portion of movement driven by said operating shaft and engaged with said lever and transmitting energy to said operating assembly; and finally moves along said third portion of movement driven by said lever and transmitting energy to said operating shaft.

In this way, it is possible to provide a four-poles circuit breaker, in which the flexion and torsion problems on the operating shaft of the circuit breaker are avoided, with also a consequent more uniform performance of the poles during the opening/closing operations.

A pole for a four-poles low voltage circuit breaker, as well as a four-poles low voltage circuit breaker, comprising a pole actuation booster mechanism as disclosed herein are also part of the present invention.

In practice, as better explained hereinafter, from an energetic standpoint the booster mechanism is totally decoupled from the operating shaft during a good portion of its movement, withdrawing energy from it only when it is need. In other words, during, e.g., a closing operation the booster mechanism starts storing energy from the operating shaft just before the movable and fixed contact become engaged with each other and the pressing action of the operating shaft is started, without withdrawing energy from the driving mechanism during most of its action. Differently from the prior art auxiliary mechanism, there are substantially no energy losses, due to frictions between the driving mechanism and the booster mechanism, during operations with the booster mechanism of the present invention, since this latter is substantially decoupled from the driving mechanism for a good portion of the opening/closing operations.

Typically, in a closing operation, the elastic means are loaded by said first operating member acting on said lever during said second portion of movement of said first operating member, i.e. when the booster mechanism starts to be engaged with the operating shaft, and are released during said third portion of movement of said first operating member, thereby forcing said lever to act on said first operating member, which in turn transmits energy to the operating shaft.

Preferably, the lever of operating assembly of the booster mechanism rotates along an arc having a dead point at which said elastic means switch from a loading condition to a releasing condition. In such a case, in correspondence of said dead point said first operating member passes from a driving condition, in which it acts on said lever, to a driven condition, in which said lever acts on it.

In a general embodiment of a pole actuation booster mechanism, according to the invention, said operating assembly preferably comprises a frame having a central and a first and a second lateral portions. The frame is conveniently adapted to be coupled to said pole and to support said first operating member and said operating assembly.

In an exemplary embodiment of the presently disclosed booster mechanism, the first operating member suitably comprises a crank which is pivoted on one of said first or second lateral portion of said frame and is adapted to be rigidly connected to the operating shaft of corresponding pole. Moreover, also the lever of the operating assembly can be suitably pivoted on one of said first or second lateral portion of said frame and is advantageously provided with a second and a third operating end.

In such a case, said second operating end of said lever is conveniently engaged with the first operating end of said first operating member (e.g. a crank) during said second portion of movement of said first operating member, and said third operating end of said lever is engaged with said first operating end of said first operating member during said third portion of movement of said first operating member.

In a preferred embodiment of pole actuation booster mechanism, according to the invention, the elastic element typically comprises one or more springs.

In such a case, said one or more springs can suitably have one end which is fixed with respect to said frame and an opposite end which is operatively connected to said lever and movable with respect to the frame along an arched path.

For instance, the opposite end of said one or more springs can be secured to a bar which is rigidly connected to said lever and which is movable with respect to the frame along said arched path.

During the opening operation of the circuit breaker, the first operating member of the booster mechanism of the invention, moves in an opposite direction with respect to the opening operation. In practice, during an opening operation of the circuit breaker, said first operating member moves first along said third portion of movement driven by said operating shaft and engaged with said lever and transmitting energy to said operating assembly, then moves along said second portion of movement driven by said lever and transmitting energy to said operating shaft, and finally moves along said first portion of movement driven by said operating shaft and disengaged form said operating assembly.

In other words, during an opening operation, the booster mechanism starts storing energy from the operating shaft when it is moving along the pressing angle, and releases it to the shaft after the first detachment between the contacts, becoming uncoupled from the shaft soon thereafter, without withdrawing any further energy therefrom or dissipating energy due to frictions between the driving mechanism and the booster mechanism.

Further features and advantages of the invention will emerge from the description of preferred, but not exclusive embodiments of the pole actuation booster mechanism, according to the invention, non-limiting examples of which are provided in the attached drawings, wherein.

Figure 1:
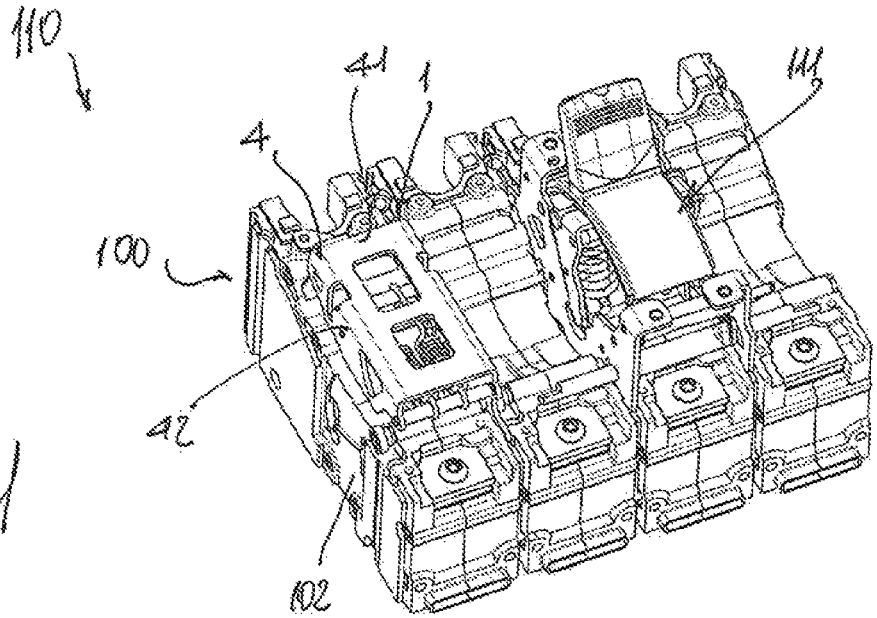
FIG. 1 is a perspective view of an embodiment of the poles and driving mechanism assembly of a four-poles circuit breaker including a pole actuation booster mechanism, according to the invention.
Figure 2:
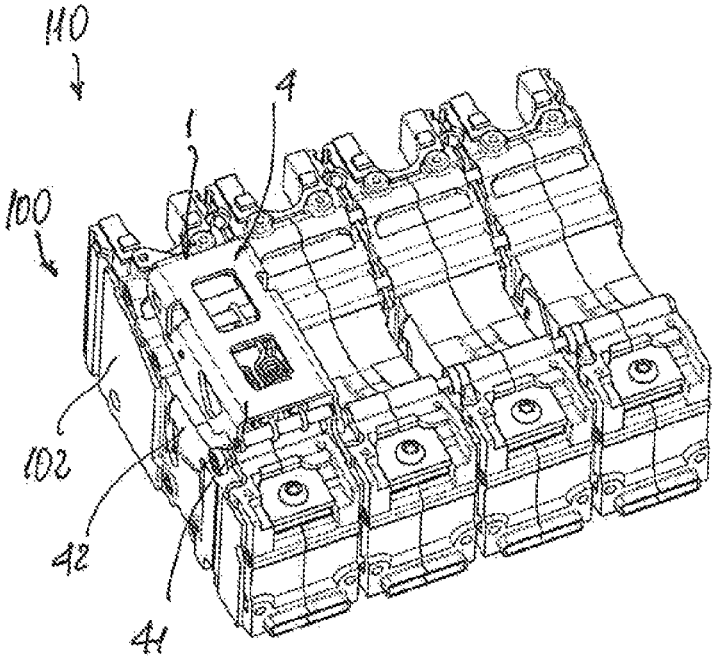
FIG. 2 is a perspective view of an embodiment of the poles assembly of a four-poles circuit breaker including a pole actuation booster mechanism, according to the invention.

With reference to the attached FIGS. 1 and 2, the pole actuation booster mechanism according to the invention, designated with the reference numeral 1, is adapted to be used in a pole 100 of a four-poles low voltage circuit breaker 110. As shown in FIG. 1, in a four-poles low voltage circuit breaker 110 the driving mechanism 111 is normally asymmetrically positioned with respect to the pole assembly. To minimize the previously mentioned problems of flexions and torsions, as well as unbalanced performances among the poles, the pole actuation booster mechanism 1 is placed on the pole 100 which is more "isolated" with respect to the driving mechanism 111.

Figure 3:
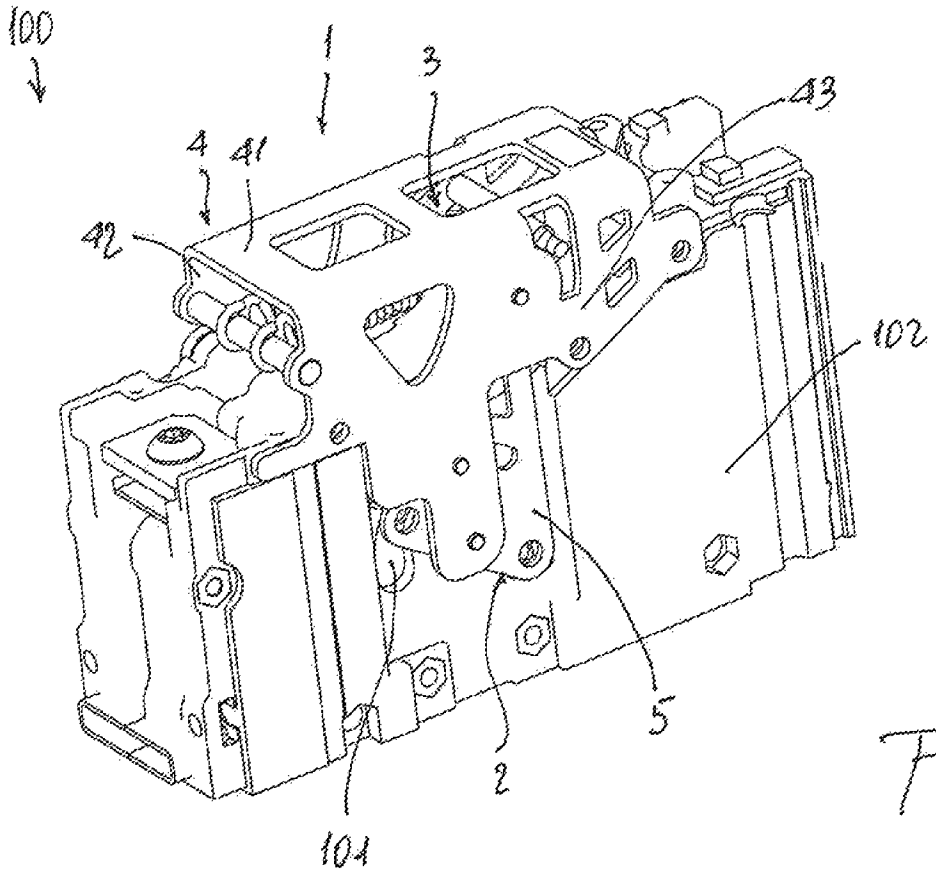
FIG. 3 is a perspective view of an embodiment of a pole including a pole actuation booster mechanism, according to the invention.
Figure 4:
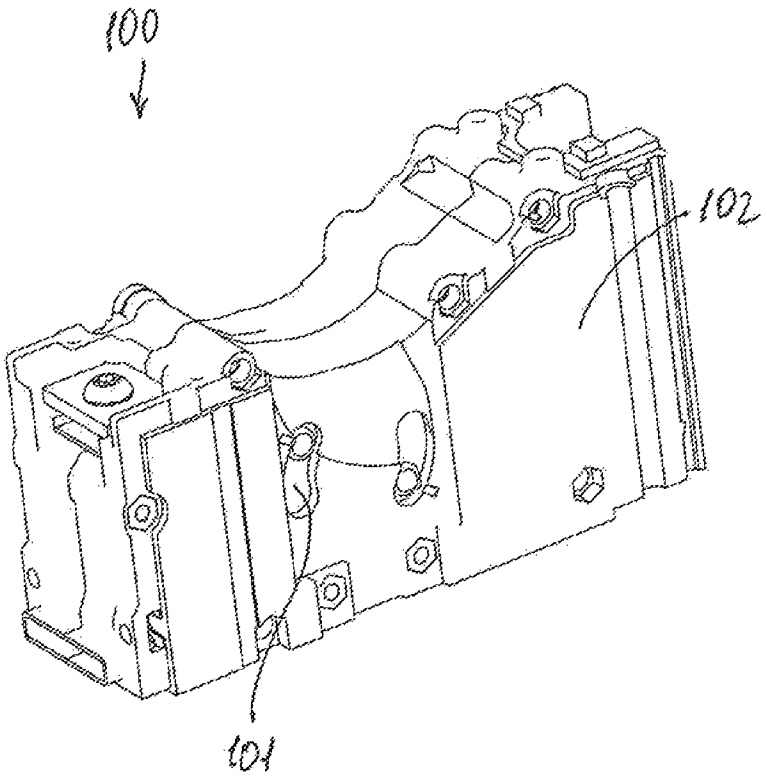
FIG. 4 is a perspective view of an exemplary embodiment of a pole in which a pole actuation booster mechanism, according to the invention, can be used.

With reference to FIGS. 3 and 4, the pole 100 comprises an operating shaft 101 and at least a fixed contact (not shown) and at least a movable contact (not shown) which are generally housed in an insulating casing 102. The movable contact is operatively coupled to said operating shaft 101 and is engageable to/disengageable from said fixed contact by rotation of said operating shaft 101 during an opening/closing operation of said circuit breaker 100.

The operating principles and functioning, as well as the related components and mechanisms, of the low voltage pole and low voltage circuit breaker used in the present invention can be of the conventional type and will not be described in further details.

One of the distinguishing features of the present invention is given by the fact that pole 100 can be conveniently equipped with a booster mechanism 1 which helps the closing/opening operation of, e.g., the "isolated" pole 100.

Figure 6:
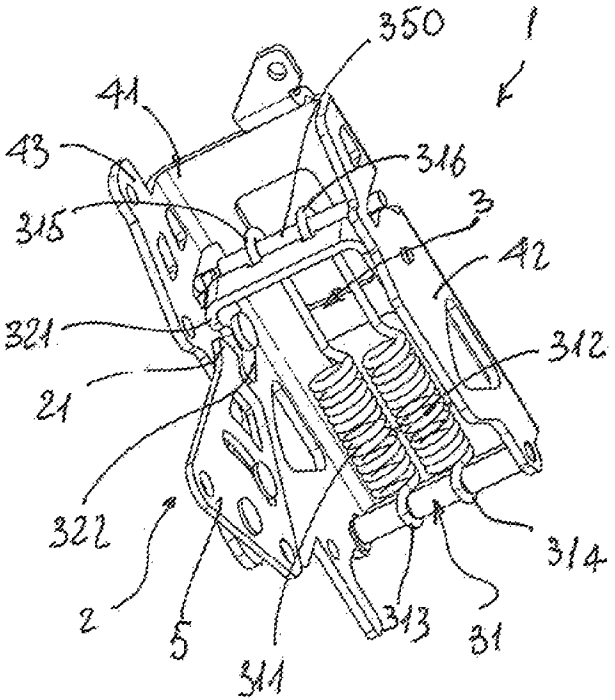
FIG. 6 is a second perspective view of a first embodiment of a pole actuation booster mechanism, according to the invention.
Figure 5:
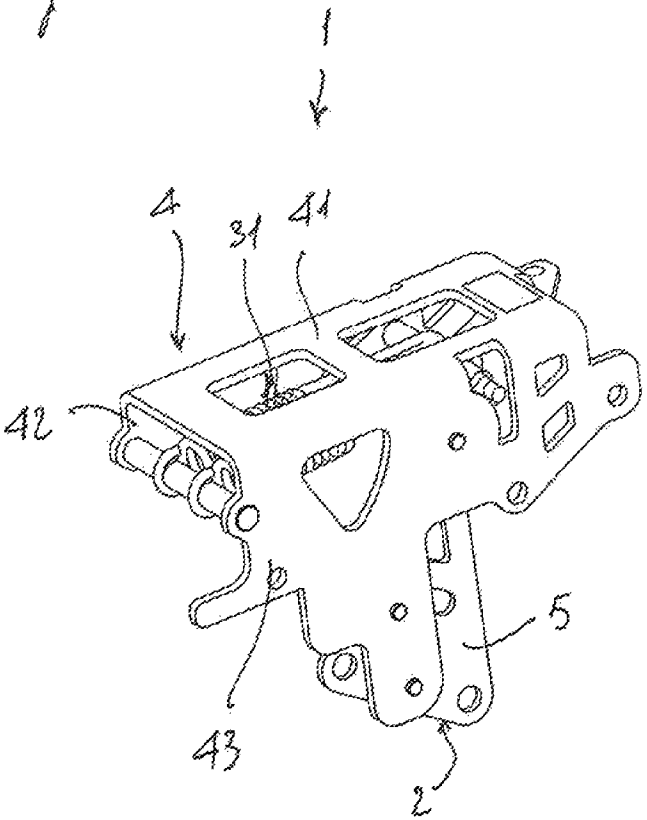
FIG. 5 is a first perspective view of a first embodiment of a pole actuation booster mechanism, according to the invention.

With particular reference to FIGS. 3, 5 and 6, the booster mechanism 1 of the present invention comprises, in its more general definition, a first operating member 2 which is adapted to be operatively connected to the operating shaft 101 of the pole 100 and which moves together with said shaft 101 during its rotation from an open position to a closed position, and vice-versa, of said circuit breaker 110.

The first operating member 2 is provided with a first operating end 21 which represents its operative interface with an operating assembly 3 comprising at least an elastic element 31 operatively connected to a lever 32.

As better explained hereinafter, the first operating member 2 moves together with the shaft 101 over a range of movement that can be divided in a first, a second and a third portion of movement during which the booster mechanism 1 has a different behavior in terms of energy relationship with the operating shaft 101.

In details, the first operating member 2 is disengaged from said operating assembly 3 during said first portion of its movement and is engaged with said lever 32 during said second and third portions of its movement.

With reference also to FIGS. 7-10, during a closing operation of the circuit breaker 110 the first operating member 2 moves first along said first portion of movement driven by said operating shaft 101 and disengaged form said operating assembly 3. In this phase, there is no transfer of energy in either direction between the operating shaft 101 and the booster mechanism 1, since they are decoupled form each other. In other words, during this phase only the first operating member 2 is drawn by the operating shaft 101, with substantial no energy transfer or losses due to frictions. At a certain point of its movement, the first operating member 2 comes into operative contact with the lever 32 and starts moving along said second portion of movement in which it is driven by said operating shaft 101 and engaged with said lever 32. During this phase there is therefore a transfer of energy from the operating shaft 101 to the operating assembly 3, which is therefore stored in the booster mechanism 1.

In a third and final phase of its movement, the first operating member 2 moves along said third portion of movement during which it is driven by said lever 32 and transmits energy to said operating shaft 101 and to the corresponding contact assembly, thereby helping to complete the closing operation of the pole 100.

Figure 8:
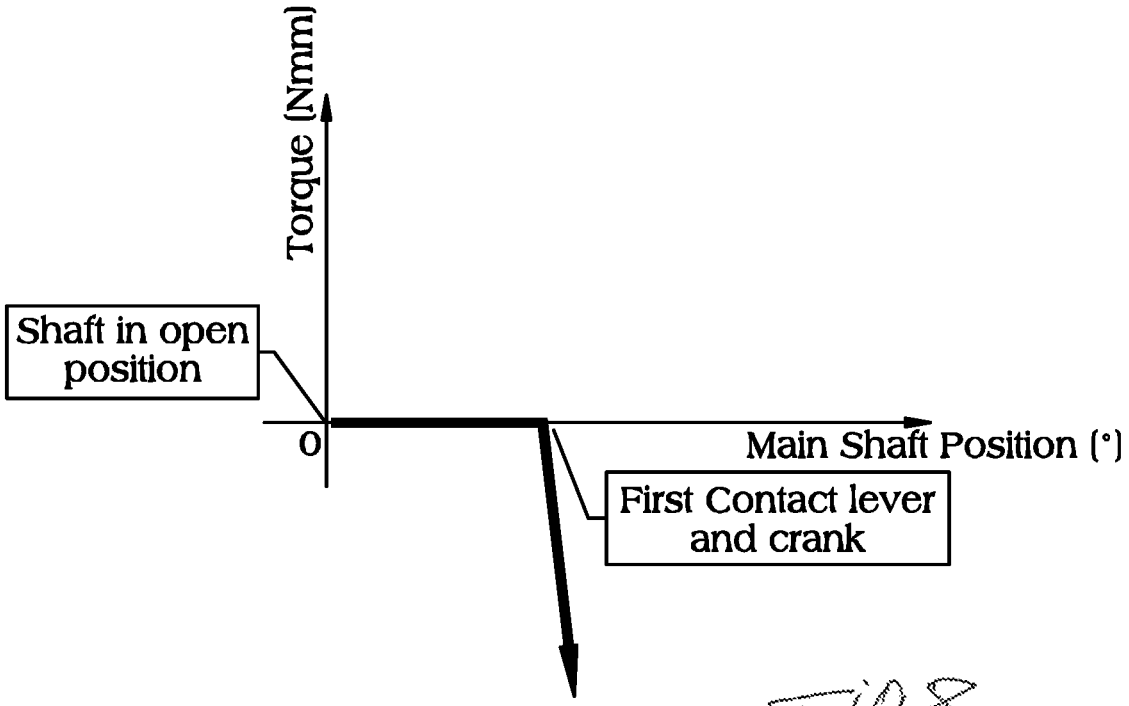
FIG. 8 is a diagram of Torque vs. Displacement (i.e. rotation) of the operating shaft of the pole of FIG. 7.
Figure 9:
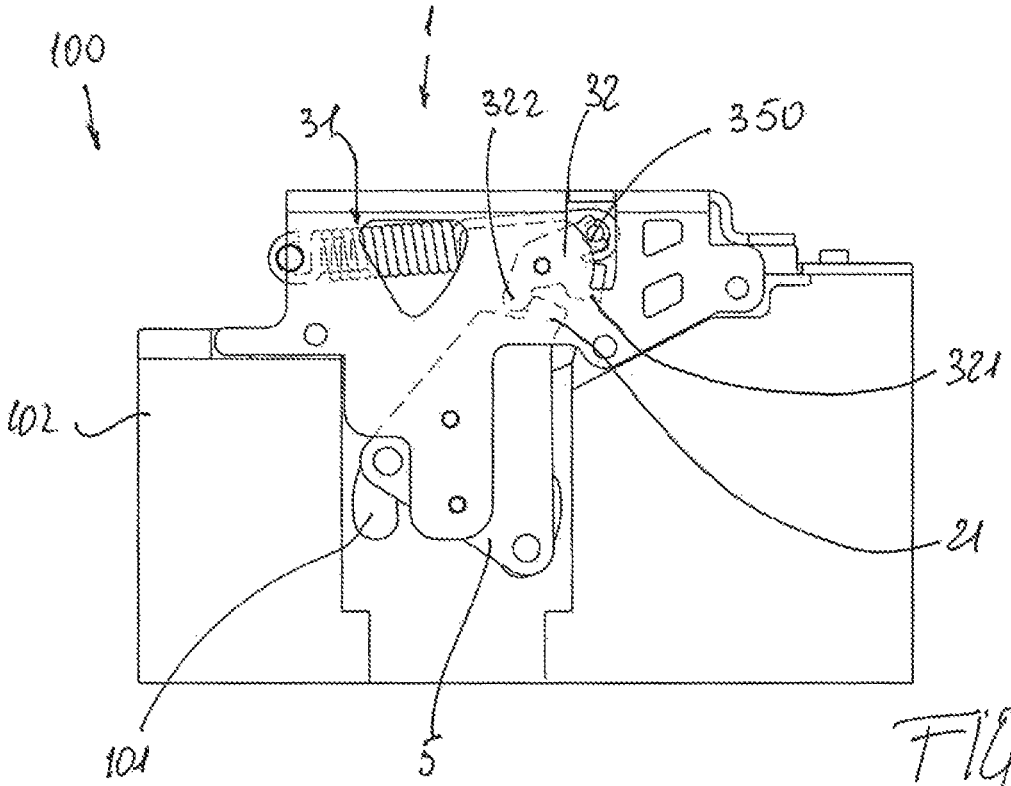
FIG. 9 is a schematic side view of an embodiment of a pole including a pole actuation booster mechanism, according to the invention, during a second phase of the closing operation.

Thus, as shown in the diagram of FIG. 8, there is no substantially energy transfer or loss during the rotation of the operating shaft 101, until when the first operating member 2 (e.g. a crank 5 as better described hereinafter) comes into contact with the lever 32 urging on it. At this point, energy starts to be transferred from the operating shaft 101 to the booster mechanism and stored therein (e.g. in the elastic element 31 as better described hereinafter).

Figure 10:
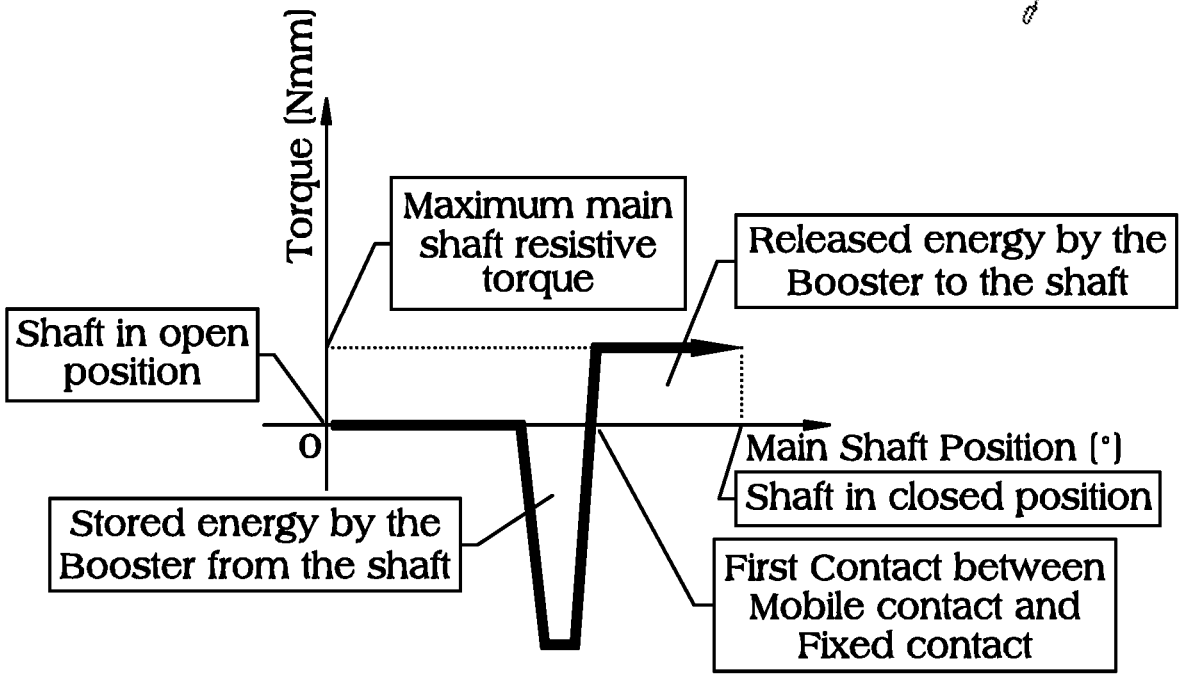
FIG. 10 is a diagram of Torque vs. Displacement (i.e. rotation) of the operating shaft of the pole of FIG. 9.
Figure 11:
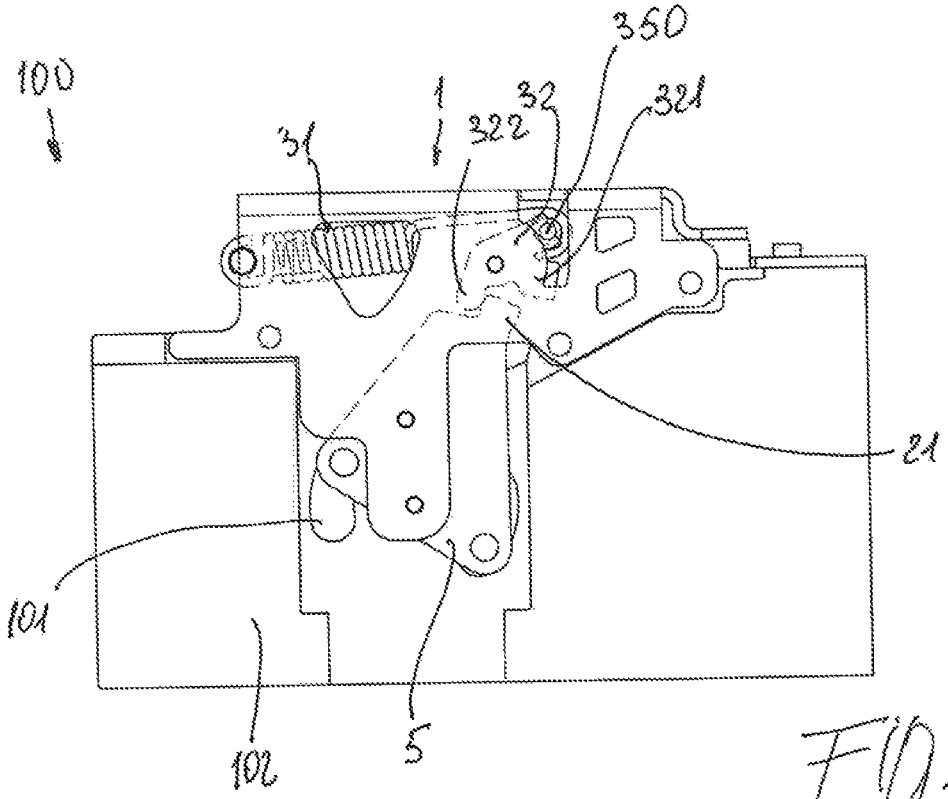
FIG. 11 is a schematic side view of an embodiment of a pole including a pole actuation booster mechanism, according to the invention, during a first phase of the opening operation.
Figure 12:
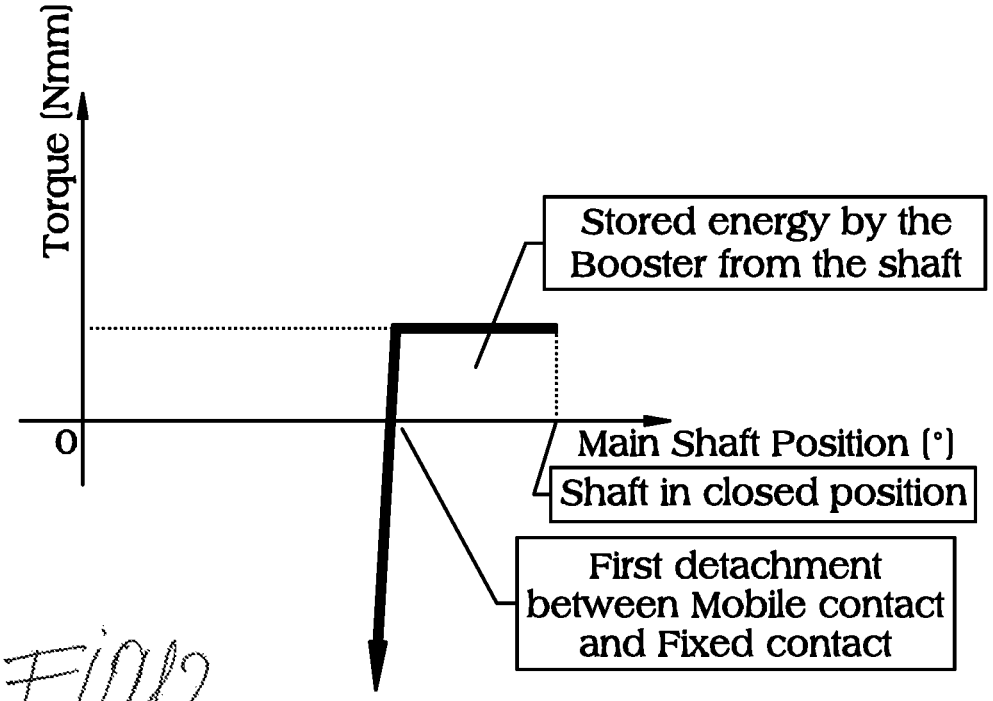
FIG. 12 is a diagram of Torque vs. Displacement (i.e. rotation) of the operating shaft of the pole of FIG. 11.
Figure 13:
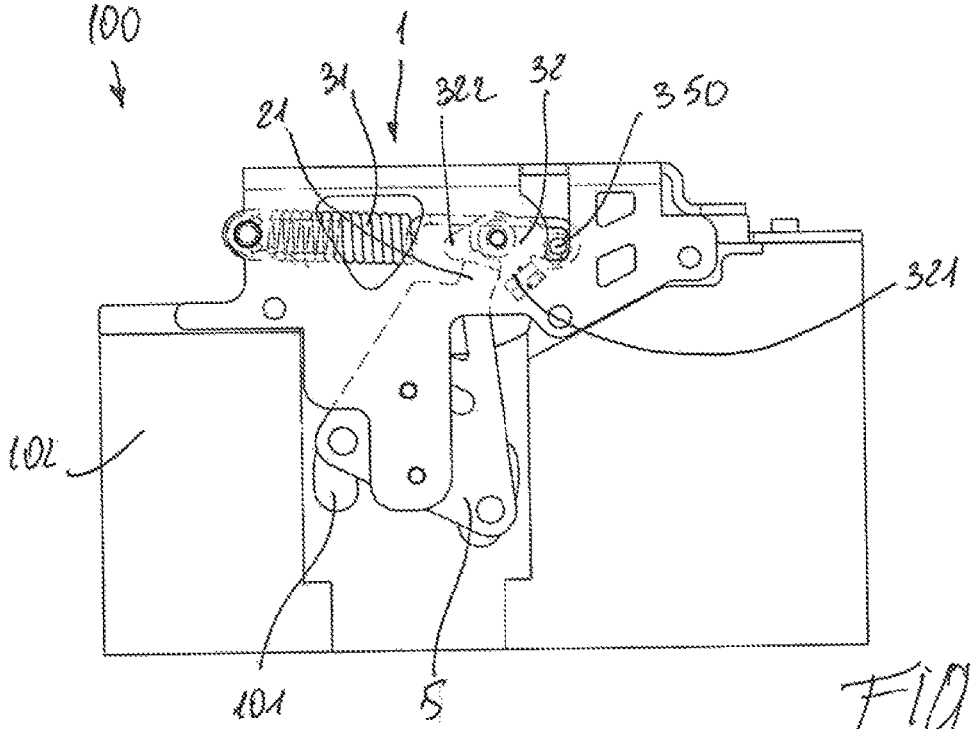
FIG. 13 is a schematic side view of an embodiment of a pole including a pole actuation booster mechanism, according to the invention, during a second phase of the opening operation.
Figure 14:
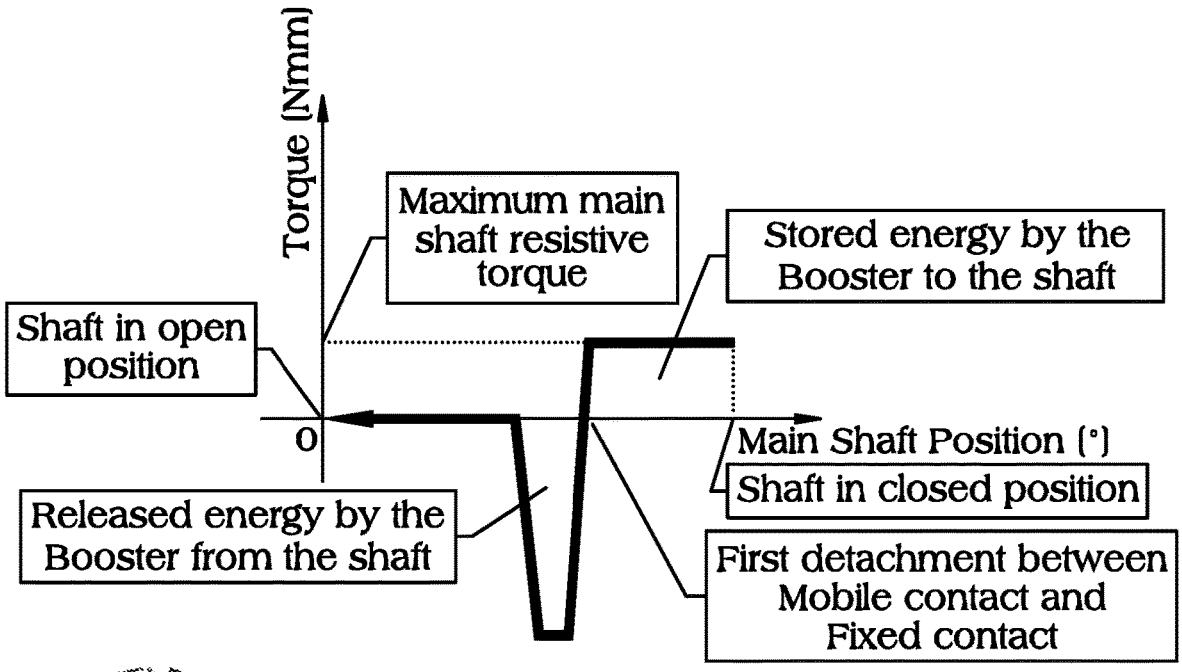
FIG. 14 is a diagram of Torque vs. Displacement (i.e. rotation) of the operating shaft of the pole of FIG. 12.

With reference to FIG. 10 this energy transfer takes place until when the movable and fixed contact are very close to each other and is then inverted with the lever 32 which is urging on the first operating member 2, meaning that immediately before the contacts are closed the energy stored in the booster mechanism 1 is released to the operating shaft 101.

In practice, said elastic means 31 are loaded by said first operating member 2 acting on said lever 32 during the second portion of movement of said first operating member 2. The elastic means 31 are then released during said third portion of movement of said first operating member 2 forcing said lever 32 to act on said first operating member 2 and transmit energy to the operating shaft 101.

From a design standpoint, this result can be achieved by making the lever 32 to rotate along an arc having a dead point at which said elastic means 31 switch from a loading condition to a releasing condition.

In this way, in correspondence of said dead point, said first operating member 2 passes from a driving condition, in which it is moved by the operating shaft 101 and acts on said lever 32 (thereby transmitting energy from the operating shaft 101 to the booster mechanism 1), to a driven condition, in which said lever 32 acts on it, thereby transmitting energy from the booster mechanism 1 to the operating shaft 101.

In details, in the embodiment of the pole actuation booster mechanism 1 shown in the attached figures, the operating assembly 3 comprises a frame 4 having a central portion 41 interposed between a first 42 and a second 43 lateral portions. Said portions 41, 42 and 43 are for instance suitably shaped plates so that said frame 4 is adapted to be coupled to the pole 100 and to support said first operating member 2 and said operating assembly 3.

The first operating member 2 comprises a crank 5 which is pivoted on one of said first 42 or second 43 lateral portion of said frame 4 and is adapted to be rigidly connected to the operating shaft 101 of said pole 100, through, e.g. pins or shafts or similar connection means.

In turn, also the lever 32 is pivoted on one of said first 42 or second 43 lateral portion of said frame 4 and, in the embodiments shown in the figures, is provided with a second 321 and a third 322 operating end.

Figure 7:
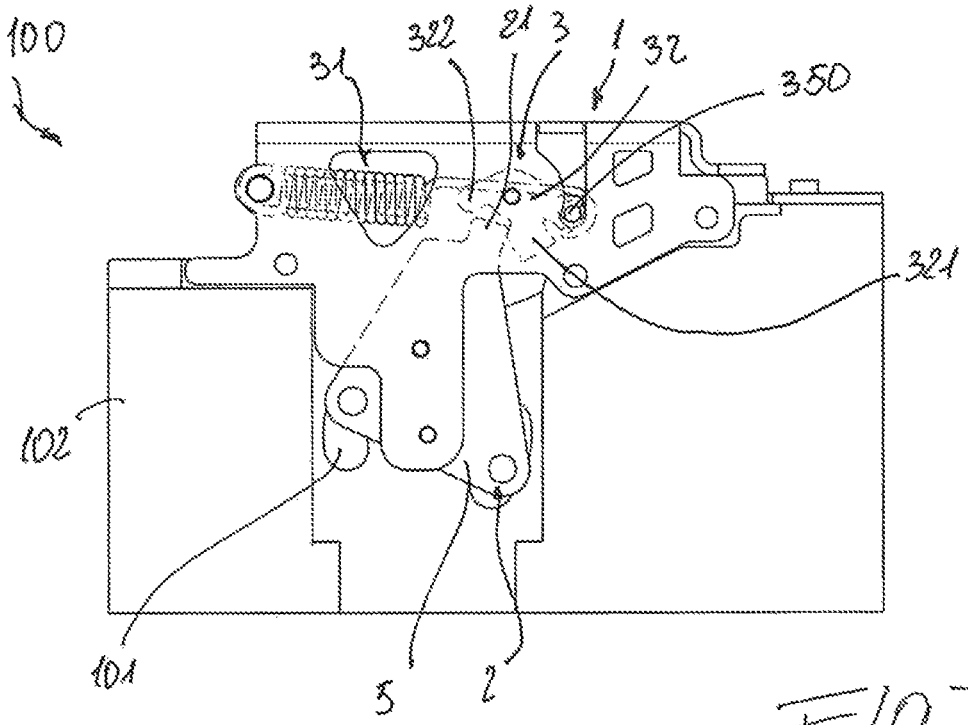
FIG. 7 is a schematic side view of an embodiment of a pole including a pole actuation booster mechanism, according to the invention, during a first phase of the closing operation.

Thus, with reference to FIG. 7, during, e.g., a closing operation of the circuit breaker, the second operating end 321 of the lever 32 is engaged with said first operating end 21 of said first operating member 2 during said second portion of movement of said first operating member 2, while said third operating end 322 of the lever 32 becomes engaged with said first operating end 21 of said first operating member 2 during the third portion of movement of said first operating member 2, e.g. of the crank 5.

In the embodiment of a pole actuation booster mechanism shown in the figures, the elastic element 31 comprises a couple of springs 311, 312.

In this case the springs 311, 312 have one end 313, 314 fixed with respect to said frame 4 and an opposite end 315, 316 which is operatively connected to said lever 32 and movable with respect to the frame 4 along an arched path.

In particular the opposite end 315, 316 (i.e. those which are not fixed with respect to the frame 4) of said one or more springs 311, 312 are secured to a bar 350 which is rigidly connected to said lever 32 and which is movable with respect to said frame 4 along said arched path. During their movement along the arched path, the springs 311, 312 are therefore stretched and released, thereby transferring energy from the operating shaft 101 to the booster mechanism 1, and viceversa.

The opening operation of the pole 100, boosted by the booster mechanism, is substantially the opposite of the opening operation.

With reference to FIGS. 11-14, during an opening operation of the circuit breaker 110 the first operating member 2 moves first along said third portion of movement in which it is driven by said operating shaft 101 and engaged with said lever 32. During this phase there is therefore a transfer of energy from the operating shaft 101 to the operating assembly 3, which is therefore stored in the booster mechanism 1.

Then, during a second phase of the opening operation, the first operating member 2 moves along said second portion of movement in which the lever 32 passes the dead point of its travel and starts driving the first operating member 2. During this phase there is therefore a transfer of energy from the booster mechanism 1 to said operating shaft 101.

Finally, at a certain point of its movement, the first operating member 2 becomes disengaged from the lever 32 and start moves along said first portion of movement driven by said operating shaft 101 and disengaged form said operating assembly 3. In this phase, there is no transfer of energy in either direction between the operating shaft 101 and the booster mechanism 1, since they are decoupled form each other.

It is clear from the above that the pole actuation booster mechanism of the present invention allows solving the above underlined problems. Indeed, there is no waste or losses of energy, as in the previously known auxiliary mechanisms, since the booster mechanism of the present invention is decoupled from the driving mechanism of the circuit breaker for most of its travelling time. In other words, the energy needed for helping the closing/opening operation of the "asymmetrical" pole of a four-poles circuit breaker is taken only when necessary, and the amount withdrawn is very limited.

Moreover, the pole actuation booster mechanism is very simple from a mechanical standpoint and requires a limited number of components, thereby not affecting negatively the overall costs of the circuit breaker.

Several variations can be made to the pole actuation booster mechanism for a pole of a four-poles low voltage circuit breakers, as well as to the corresponding pole and four-poles low voltage circuit breaker, thus conceived, all falling within the scope of the attached claims. In practice, the materials used and the contingent dimensions and shapes can be any, according to requirements and to the state of the art.

The invention claimed is:

1. A pole actuation booster mechanism, adapted to operate on a pole of a four-pole low voltage circuit breaker, said pole comprising an operating shaft, a fixed contact, and a movable contact operatively coupled to said operating shaft and engageable to and disengageable from said fixed contact by rotation of said operating shaft during an opening operation or a closing operation of said four-pole low voltage circuit breaker, the pole actuation booster mechanism comprising:

a first operating member adapted to be operatively connected to said operating shaft and moving together with said operating shaft during rotation of said operating shaft from an open position to a closed position, and vice-versa, of said four-pole low voltage circuit breaker over a range of movement having a first portion of movement, a second portion of movement, and a third portion of movement, said first operating member having a first operating end; and an operating assembly comprising an elastic element operatively connected to a lever, the first operating member disengaged from said operating assembly during said first portion of movement and engaged with said lever during said second and third portions of movement, wherein during the closing operation of said four-pole low voltage circuit breaker, said first operating member moves first along said first portion of movement driven by said operating shaft and is disengaged from said operating assembly, and finally moves along said third portion of movement driven by said lever and transmits energy to said operating shaft.

2. The pole actuation booster mechanism according to claim 1, wherein said elastic element is loaded by said first operating member acting on said lever during said second portion of movement of said first operating member and is released during said third portion of movement of said first operating member forcing said lever to act on said first operating member.

3. The pole actuation booster mechanism according to claim 2, wherein said lever rotates along an arc having a dead point at which said elastic element switches from a loading condition to a releasing condition.

4. The pole actuation booster mechanism according to claim 3, characterized in that wherein in correspondence of said dead point said first operating member passes from a driving condition, in which said first operating member acts on said lever, to a driven condition, in which said lever acts on said first operating member.

5. The pole actuation booster mechanism according to claim 4, wherein said operating assembly further comprises a frame having a central lateral portion, a first lateral portion, and a second lateral portion, said frame adapted to be coupled to said pole and supporting said first operating member and said operating assembly.

6. The pole actuation booster mechanism according to claim 5, wherein said first operating member comprises a crank pivoted on one of said first or second lateral portion of said frame and adapted to be rigidly connected to said operating shaft of said pole.

7. The pole actuation booster mechanism according to claim 6, wherein said lever is pivoted on one of said first or second lateral portion of said frame and is provided with a second operating end and a third operating end.

8. The pole actuation booster mechanism according to claim 4, wherein a second operating end of said lever is engaged with said first operating end of said first operating member during said second portion of movement of said first operating member, and a third operating end of said lever is engaged with said first operating end of said first operating member during said third portion of movement of said first operating member.

9. The pole actuation booster mechanism according to claim 1, wherein said elastic element comprises one or more springs.

10. The pole actuation booster mechanism according to claim 5, wherein said elastic element comprises one or more springs, and wherein said one or more springs have one end fixed with respect to said frame and an opposite end operatively connected to said lever and movable with respect to the frame along an arched path.

11. The pole actuation booster mechanism according to claim 10, wherein the opposite end of said one or more springs is secured to a bar rigidly connected to said lever and movable with respect to said frame along said arched path.

12. The pole actuation booster mechanism according to claim 1, wherein during an operation of said four-pole low voltage circuit breaker, said first operating member moves along said third portion of movement driven by said operating shaft, engaged with said lever, and transmits energy to said operating assembly, and then moves along said second portion of movement driven by said lever and transmits energy to said operating shaft, and finally moves along said first portion of movement driven by said operating shaft and disengaged from said operating assembly.

13. A low voltage pole comprising the pole actuation booster mechanism according to claim 1.

14. A four-pole low voltage circuit breaker comprising the low voltage pole according to claim 13.

15. The pole actuation booster mechanism according to claim 1, wherein said operating assembly further comprises a frame having a central lateral portion, a first lateral portion, and a second lateral portion, said frame adapted to be coupled to said pole and supporting said first operating member and said operating assembly.

16. The pole actuation booster mechanism according to claim 15, wherein said first operating member further comprises a crank pivoted on one of said first or second lateral portion of said frame and adapted to be rigidly connected to said operating shaft of said pole.

17. The pole actuation booster mechanism according to claim 16, wherein a second operating end of said lever is engaged with said first operating end of said first operating member during said second portion of movement of said first operating member, and a third operating end of said lever is engaged with said first operating end of said first operating member during said third portion of movement of said first operating member.

18. The pole actuation booster mechanism according to claim 9, wherein said one or more springs have one end fixed with respect to a frame and an opposite end operatively connected to said lever and movable with respect to the frame along an arched path.

19. The pole actuation booster mechanism according to claim 18, wherein the opposite end of said one or more springs is secured to a bar rigidly connected to said lever and movable with respect to said frame along said arched path.

20. The pole actuation booster mechanism according to claim 7, wherein during an operation of said four-pole low voltage circuit breaker, said first operating member moves along said third portion of movement driven by said operating shaft, engaged with said lever, and transmits energy to said operating assembly, and then moves along said second portion of movement driven by said lever and transmits energy to said operating shaft, and finally moves along said first portion of movement driven by said operating shaft and disengaged from said operating assembly.

* * * * *